US006608596B2

(12) United States Patent
Bien et al.

(10) Patent No.: US 6,608,596 B2
(45) Date of Patent: Aug. 19, 2003

(54) MICROWAVE REFLECTOR ANTENNA

(75) Inventors: Albert Louis Bien, Anaheim, CA (US); Glenn J. Desargant, Fullerton, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/975,858

(22) Filed: Oct. 12, 2001

(65) Prior Publication Data

US 2003/0071758 A1 Apr. 17, 2003

(51) Int. Cl.[7] ..... H01Q 1/28
(52) U.S. Cl. ..... 343/705; 343/766
(58) Field of Search ..... 343/705, 765, 343/766

(56) References Cited

U.S. PATENT DOCUMENTS 2,702,346 A * 2/1955 Evans et al. ..... 343/705
3,624,656 A 11/1971 Kaschak et al. ..... 343/766
3,739,385 A * 6/1973 Bechtel et al. ..... 343/705
3,860,930 A 1/1975 Peterson ..... 343/705
4,593,288 A * 6/1986 Fitzpatrick ..... 343/705
5,805,115 A 9/1998 Pellerin et al. ..... 343/763
6,204,823 B1 3/2001 Spano et al. ..... 343/766

* cited by examiner

*Primary Examiner*—Michael C. Wimer
(74) *Attorney, Agent, or Firm*—Harness Dickey & Pierce P.L.C.

(57) ABSTRACT

A microwave reflector antenna for use on an aircraft. The microwave reflector antenna has a stationary plate that is attached to and stationary relative to the aircraft. A rotary plate rotates relative to the stationary plate about an azimuth axis. A rotary joint is attached to the rotary plate and has an axis of rotation that is aligned with the azimuth axis. A reflector is attached to the rotary plate adjacent the rotary joint so that the azimuth axis does not intersect the reflector. Individual ball bearings are positioned between the rotary plate and the stationary plate to allow the rotary plate to rotate about the azimuth axis. The stationary plate has gear teeth positioned along a peripheral side wall of the stationary plate. An azimuth motor is attached to the rotary plate and engaged with the gear teeth to selectively rotate the rotary plate about the azimuth axis.

20 Claims, 2 Drawing Sheets

43
26
56
50
52
48
54
44
38
44
22

78
72
82
34
84
22
66
68
90
31
28
30
50
52
3
70
43
38
40
68
36
64

MICROWAVE REFLECTOR ANTENNA

FIELD OF THE INVENTION

The present invention relates to microwave reflector antenna and, more specifically, to a microwave reflector antenna for attachment to an aircraft.

BACKGROUND OF THE INVENTION

Microwave reflector antennas can be used in airborne applications. For example, microwave reflector antennas can be used on an aircraft to allow the aircraft to communicate with other parties. When the microwave reflector antenna is used on an aircraft, the microwave reflector antenna is typically positioned on the crown of the exterior of the aircraft. The positioning of the microwave reflector antenna on the exterior of the aircraft increases the drag of the aircraft as it travels through the atmosphere and exposes the microwave reflector antenna to the harsh environments that the aircraft is exposed to. Therefore, the microwave reflector antennas are typically covered by a radome which completely covers the microwave reflector antenna and reduces the drag caused by positioning the microwave reflector antenna on the exterior of the aircraft.

The radome is designed to cover the microwave reflector antenna and to reduce the drag on the aircraft caused by the microwave reflector antenna. To achieve a reduction in the drag on the aircraft associated with covering a microwave reflector antenna with a radome, the radome is gradually tapered from its peak to its ends. The typical radome will have a length along the aircraft of approximately 10 to 12 inches for every inch of height for which the radome must extend above the aircraft to cover the microwave reflector antenna. The typical microwave reflector antenna requires a radome of approximately 10 to 12 ft. or more in length to cover the microwave reflector antenna.

Because the cost of the radome is proportional to the size of the radome, any reduction in the height of the radome and the resulting length of the radome will result in a cost savings. Additionally, decreasing the size of the radome will also decrease the drag caused by the radome on the aircraft. Therefore, it is desirable to reduce the height of the microwave reflector antenna so that the height of the radome and its resulting length can also be reduced. In a typical application, every inch of reduction in the height of the radome will result in a length reduction of approximately 10 to 12 inches.

The typical microwave reflector antenna has a reflector that is capable of rotating about two different axis. The first axis of rotation is the azimuth axis. Rotation of the reflector about the azimuth axis allows the reflector to rotate 360° so that the reflector can point in any direction along the horizon. The second axis of rotation is the elevation axis. Rotation of the reflector about the elevation axis allows the elevation of the reflector to be adjusted so that the reflector can be oriented between the horizon and the sky.

The typical microwave reflector antenna has a stationary or base plate that is attached to the aircraft and remains stationary relative to the aircraft. A rotating plate allows the reflector to rotate about the azimuth axis. The rotating plate and stationary plate are separated by a radial/thrust bearing. The radial/thrust bearing is a separate part that is positioned between the stationary plate and rotating plate and allows the rotating plate to rotate relative to the stationary plate about the azimuth axis. The use of a separate radial/thrust bearing results in an increase in height of the microwave reflector antenna. The increased height thereby increases the aerodynamic drag and increases the size of the radome required to cover the microwave reflector antenna. Therefore, it is desirable to have a bearing that allows the rotary plate to rotate relative to the stationary plate and is of minimal height.

The typical microwave reflector antenna has a rotary joint that is attached to the rotating plate and has an axis of rotation that is aligned with the azimuth axis. The rotary joint allows electric signals to pass between the reflector and the aircraft. The rotary joints are usually several inches in height at a minimum and are placed directly under the reflector. The placement of the rotary joint directly under the reflector raises the height of the microwave reflector antenna several inches and increase the height and size of the radome required to cover the microwave reflector antenna.

The typical microwave reflector antenna also has an azimuth motor that causes the rotation of the reflector about the azimuth axis. The azimuth motor has a pinion gear that engages with teeth that are stationary relative to the rotating plate and allows the azimuth motor to cause the rotary plate to rotate about the azimuth axis. The location of teeth and the azimuth motor can effect the overall height of the microwave reflector antenna and the associated size of the required radome.

Therefore, what is needed is a microwave reflector antenna that has a minimum height so that the radome necessary to cover the microwave reflector antenna is also of a minimum size.

SUMMARY OF THE INVENTION

The microwave reflector antenna of the present invention is for use on the exterior of an aircraft. The microwave reflector antenna is designed to achieve a minimal height so that a radome that covers the microwave reflector antenna can be of minimal size.

The airborne microwave reflector antenna of the present invention generally comprises a stationary plate attached to the aircraft so that the stationary plate does not move relative to the aircraft. There is a rotary plate that is capable of rotating relative to the stationary plate about an azimuth axis. A rotary joint is attached to the rotary plate. The rotary joint has an axis of rotation that is aligned with the azimuth axis so that rotation of the rotary plate causes the rotary joint to rotate about the azimuth axis. A reflector is attached to the rotary plate and rotates about the azimuth axis with the rotation of the rotary joint. The reflector is positioned adjacent to the rotary joint so that the axis of rotation of the rotary joint does not intersect the reflector. The azimuth motor selectably causes the rotary plate to rotate about the azimuth axis. The locating of the reflector adjacent the rotary joint allows the height of the rotary joint to not affect the height of the reflector and the subsequent height of the microwave reflector antenna. That is, the reflector is not positioned directly above the rotary joint and, as a result, can be positioned closer to the rotating plate and reduce the overall height of the microwave reflector antenna.

In another aspect of the present invention, a microwave reflector antenna has individual loose ball bearings positioned between the stationary plate and the rotary plate. The individual loose ball bearings allow the rotary plate to rotate relative to the stationary plate about the azimuth axis. The individual loose ball bearings are integrated into the stationary and rotary plates and are used in place of the separate radial/thrust bearing used in a typical microwave reflector antenna. By integrating the individual loose ball bearings directly into the stationary and rotary plates, the use of a separate radial/thrust bearing is avoided and a reduction in the height of the microwave reflector antenna can be achieved.

In another aspect of the invention, a microwave reflector antenna has a stationary plate with gear teeth machined into the stationary plate. The azimuth motor is attached to the rotary plate. The azimuth motor has a pinion gear with teeth that are complementary to the gear teeth on the stationary plate. The azimuth motor is attached to the rotary plate with the teeth on the pinion gear engaged with the gear teeth on the stationary plate. The azimuth motor can be selectively operated to selectively cause the rotary plate to rotate about the azimuth axis by rotating the pinion gear. The integration of the gear teeth into the stationary plate eliminates the need for a separate gear to be attached to the stationary plate.

The reduction in height of the airborne microwave reflector antenna provided by the present invention allows for the size of the radome that covers the microwave reflector antenna to be reduced. The reduction in the size of the radome reduces costs and decreases the drag on the aircraft caused by the microwave reflector antenna being attached to the aircraft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figures 2, 3:
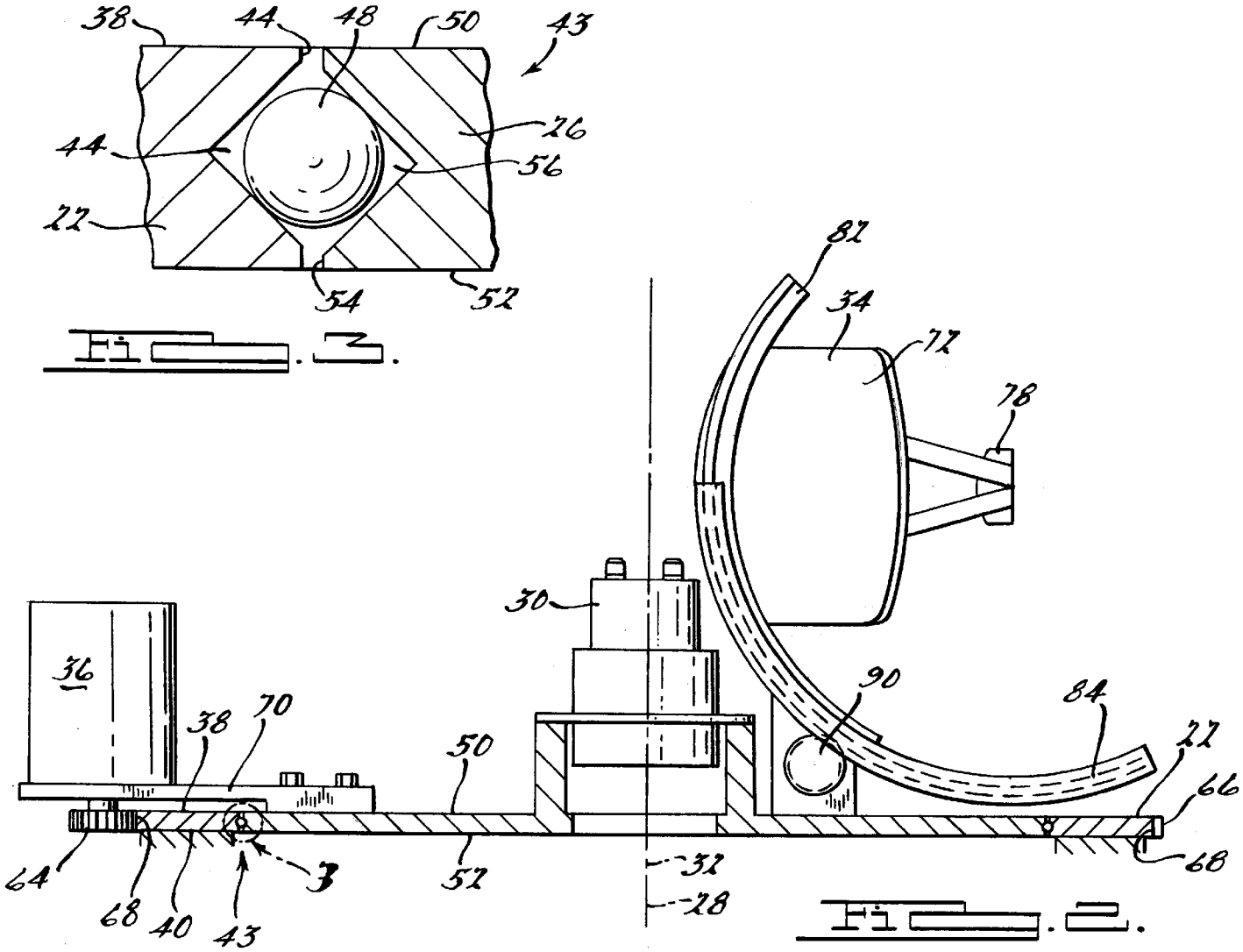
FIG. 2 is a partial cross-sectional view of the microwave reflector antenna of FIG. 1 along line 2—2.
FIG. 3 is an enlarged view of the integral ball bearing of the microwave reflector antenna of FIG. 2.

Referring to FIG. 2, a microwave reflector antenna 20 in accordance with a preferred embodiment of the present invention is shown. The microwave reflector antenna 20 is generally comprised of a stationary plate 22 which can be attached to an aircraft 24 upon which the microwave reflector antenna 20 is desired to be attached. There is a rotary plate 26 which is capable of rotating relative to the stationary plate 22. The rotary plate 26 rotates about an azimuth axis 28. A rotary joint 30 is attached to the rotary plate 26 so that the axis of rotation of the rotary joint 30 is aligned with the azimuth axis 28. The rotation of the rotary plate 28 causes the rotary joint 30 to rotate about the azimuth axis 28. A reflector 34 is connected (as will be discussed in more detail below) to the rotary plate 26 so that as the rotary plate 26 rotates about the azimuth axis 28, the reflector 34 also rotates about the azimuth axis 28. An azimuth motor 36 controls the rotation of the rotary plate 28 about the azimuth axis 28.

The stationary plate 22 has axially opposite top and bottom surfaces 38, 40 and a circular opening 42 extending therebetween. An axial side wall 44 defines the circular opening 42 and extends between the top and bottom surfaces 38, 40 of the stationary plate 22. The circular opening 42 is designed to receive the rotary plate 26 so that the rotary plate 26 can rotate relative to the stationary plate 22 within the circular opening 42. Because the rotary plate 26 is designed to be positioned within the stationary plate 22, the azimuth axis 28 is generally centered within the circular opening 42.

In a preferred embodiment, the height of the microwave reflector antenna 20, as shown in FIGS. 2 and 3, is reduced by replacing the separate radial/thrust bearing used on typical microwave reflector antennas with a bearing 43 that is integrated into the stationary and rotary plates 22, 26. To create the integral bearing 43, the axial side wall 44 of the stationary plate 22 has an annular recess 46 turned/machined/ground into the axial side wall 44. The annular recess 46 is dimensioned to receive individual loose ball bearings 48 that are used to create the integral bearing 43, as will be discussed in more detail below.

The rotary plate 26 has axially opposite top and bottom surfaces 50, 52 and a peripheral side wall 54 that extends axially therebetween. The peripheral side wall 54 of the rotary plate 26 is circular and dimensioned so that the peripheral side wall 54 of the rotary plate 26 can fit within the circular opening 42 in the stationary plate 22. When the rotary plate 26 is positioned in the circular opening 42 of the stationary plate 22, an axis of rotation (not shown) of the rotary plate 26 is aligned with the azimuth axis 28 so that rotation of the rotary plate 26 within the circular opening 42 of the stationary plate 22 causes the rotary plate 26 to rotate about the azimuth axis 28. To create the integral bearing 43, the peripheral side wall 54 of the rotary plate 26 has an annular recess 56. The annular recess 56 is turned/machined into the peripheral side wall 54. The annular recess 56 extends radially inward from the peripheral side wall 54 of the rotary plate 26 toward the axis of rotation (not shown) of the rotary plate 26. The annular recess 56 is dimensioned to receive the individual loose ball bearings 48, as will be discussed below.

When the rotary plate 26 is positioned in the circular opening 42 of the stationary plate 22, the annular recess 56 of the rotary plate 26 is aligned with and communicates with the annular recess 46 of the stationary plate 22. The two annular recesses 56, 46 thereby form respective inner and outer races of the integral bearing 43. The individual loose ball bearings 48 are positioned, as will be discussed in more detail below, in the annular recesses 46, 56 to form the integral bearing 43 that facilitates the rotation of the rotary plate 26 relative to the stationary plate 22.

Preferably, when the rotary plate 26 is positioned in the circular opening 42 in the stationary plate 22, the top surface 50 along the peripheral side wall 54 of the rotary plate 26 is aligned with and co-planer with the top surface 38 along the circular opening 42 of the stationary plate 22. The alignment of the top surfaces 38, 50 allow the stationary plate 22 and the rotary plate 26 to be of a minimal height and reduce the overall height of the microwave reflector antenna 20.

Preferably, the top surface 38 of the stationary plate 22 has an opening 58 along the axial side wall 44 that allows access to the annular recess 46 so that the individual loose ball bearings 48 can be inserted into the annular recess 46, as will be discussed below. It is also preferred that the top surface 50 of the rotary plate 26 have an opening 60 along the peripheral side wall 54 that allows access to the annular recess 56 so that the individual loose ball bearings 48 can be inserted into the annular recess 56, as will be described below. Preferably, the openings 58, 60 are symmetrical when the openings 58, 60 are aligned.

The openings 58, 60 in the respective top surfaces 38, 50 of the stationary plate 22 and the rotary plate 26 form an access opening 62 when the two openings 58, 60 are aligned. The access opening 62 is dimensioned to allow the individual loose ball bearings 48 to pass through the access opening 62. Preferably, the two openings 58, 60 are dimensioned so that an individual loose ball bearing 48 can not pass through either opening 58, 60 when the openings 58, 60 are not aligned.

To insert the individual loose ball bearings 48 into the annular recesses 46, 56, the rotary plate 26 is rotated relative to the stationary plate 22 until the opening 60 in the top surface 50 of the rotary plate 26 is aligned with the opening 58 in the top surface 38 of the stationary plate 22 and the access opening 62 is formed. When the two openings 60, 58 are aligned and form the access opening 62, the individual loose ball bearings 48 can be inserted into the annular recesses 46, 56. Each individual loose ball bearing 48 is inserted into the annular recesses 46, 56 by pushing or dropping the individual loose ball bearing 48 through the access opening 62. The individual loose ball bearings 48 are inserted one at a time through the access opening 62 until the annular recesses 46, 56 are full. After filling the annular recesses 46, 56, the rotary plate 26 is rotated so that the access opening 62 is no longer formed. Plugs (not shown) are then placed in the openings 58, 60. The plugs are dimensioned to not obstruct the rotation of the rotary plate 26. The plugs prevent the individual loose ball bearings 48 from coming out of the annular recesses 46, 56 when the openings 58, 60 are aligned.

Figure 1:
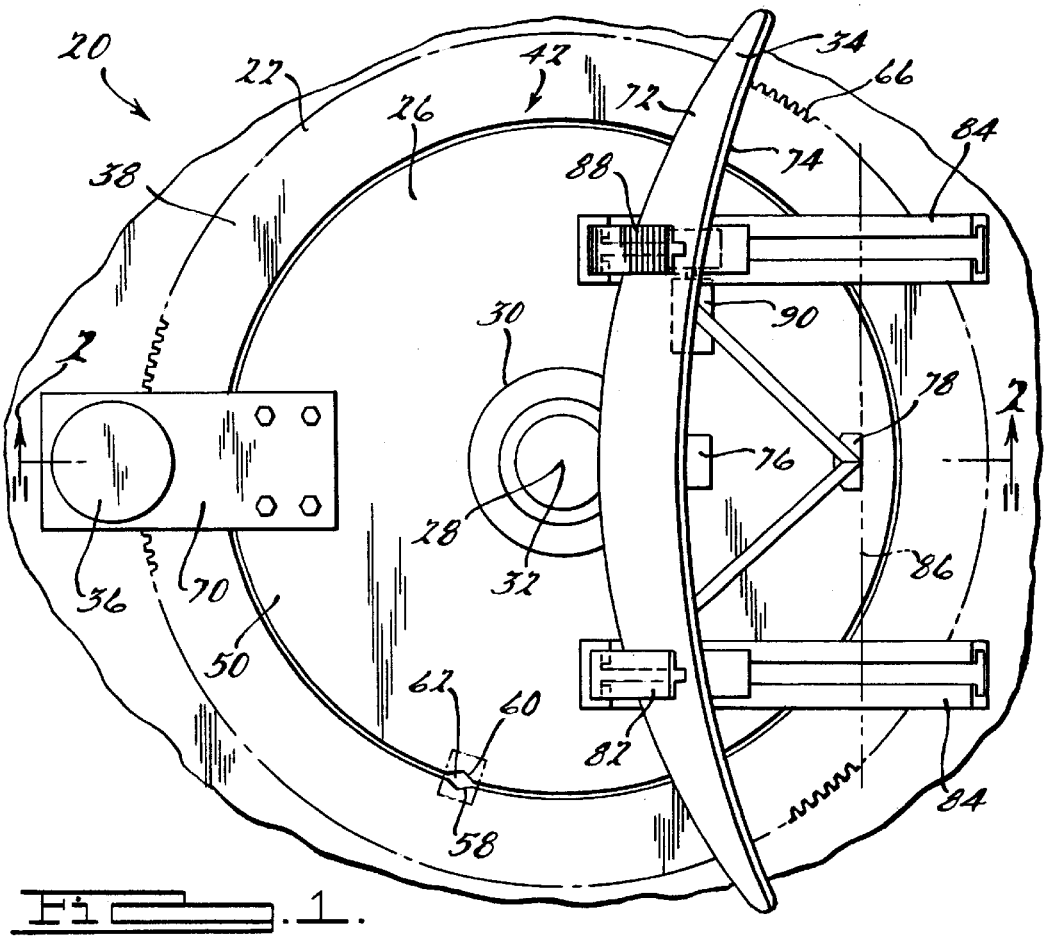
FIG. 1 is an overhead view of a microwave reflector antenna of the present invention.
Figure 4:
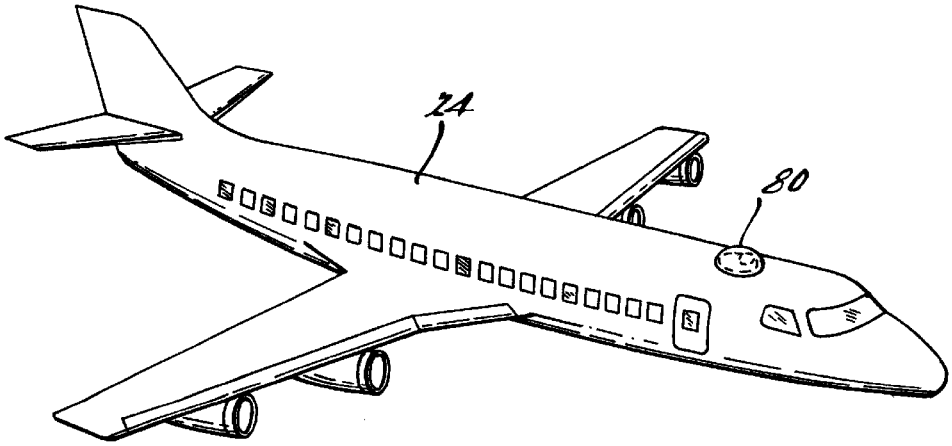
FIG. 4 is a perspective view of an aircraft with the microwave reflector antenna of FIG. 1 attached to the aircraft.

While the annular recesses 46, 56 are shown as being V-shaped grooves, it should be understood that a variety of configurations for the shape of the annular recesses 46, 56 can be utilized. For example, the annular recesses 46, 56 could be rectangular in cross sectional shape or semicircular in cross-sectional shape. Additionally, while the openings 58, 60 are shown in FIG. 1 as being V-shaped, it should be understood that a variety of shapes can be utilized without departing from the scope of the invention. For example, the openings 58, 60 can be semi-circular in shape or rectangular in shape and still be within the scope of the invention. It should also be understood that while the openings 58, 60 are preferably symmetrical when aligned, symmetry is not necessary and non-symmetrical openings 58, 60 are within the scope of the invention.

The stationary plate 22 and the rotary plate 26 can be made from a variety of materials. However, the material used to make the stationary plate 22 and the rotary plate 26 needs to be capable of being used as inner and outer races of the integral bearing 43 and to last for a long period of time. Therefore, it is preferred that the stationary plate 22 and the rotary plate 26 be made of metal. Even more preferably, the stationary plate 22 and the rotary plate 26 are made of stainless steel. The strength and hardness of stainless steel allows the annular recesses 46, 56 to act, respectively, as outer and inner races of the integral bearing 43. The strength of stainless steel also minimizes the required thickness of the stationary plate 22 and the rotary plate 26 so that an overall height of the microwave reflector antenna 20 can be reduced. Furthermore, the use of stainless steel minimizes corrosion and the effects of the environment on the microwave reflector antenna 20.

The azimuth motor 36 is used to selectively cause the rotary plate 26 to rotate about the azimuth axis 28. Preferably, the azimuth motor 36 is a stepper motor that is capable of small incremental movements so that precise movement of the reflector 34 can be attained. The azimuth motor 36 has a pinion gear 64 which rotates in response to operation of the azimuth motor 36. The stationary plate 22 has gear teeth 66 which are complementary to the azimuth pinion gear 64. The azimuth motor 36 is positioned on the rotary plate 26 so that the pinion gear 64 engages the gear teeth 66 on the stationary plate 22. The operation of the azimuth motor 36 causes the rotary plate 26 to rotate relative to the stationary plate 22.

Preferably, the gear teeth 66 and the stationary plate 22 are integral. That is, the stationary plate 22 and the gear teeth 66 are formed from a single piece of material and the gear teeth 66 are formed by machining the stationary plate 22 to form the gear teeth 66. The gear teeth 66 can be positioned in a variety of locations on the stationary plate 22. However, it is preferred that the stationary plate gear teeth 66 be positioned on a peripheral side wall 68 of the stationary plate 22. The peripheral side wall 68 extends axially between the top and bottom surfaces 38, 40 of the stationary plate 22. Preferably, the gear teeth 66 extend radially outward from the peripheral side wall 68 and do not extend above or below the respective top and bottom surfaces 38, 40 of the stationary plate 22. When the gear teeth 66 are on the peripheral side wall 68 of the stationary plate 22, it is preferred that the azimuth motor 36 be mounted on a cantilevered bracket 70. The cantilevered bracket 70 is attached to the rotary plate 26 and extends radially outward so that the azimuth motor 36 can be attached to the centilevered bracket 70 and the pinion gear 64 can engage with the gear teeth 66 on the peripheral side wall 68 of the stationary plate 22. The cantilevered bracket 70 could be integral to the rotary plate 26 with the rotary plate 26 and the cantilevered bracket 70 being made from a single piece of material.

The reflector 34 has opposite convex and concave surfaces 72, 74. A horn 76 is positioned on the concave surface 74 of the reflector 34. The horn emits microwave energy that is directed at a subreflector 78. The subreflector 78 reflects the microwave energy toward the concave surface 74 of the reflector 34. The microwave energy then reflects off the concave surface 74 toward a desired recipient as is known in the art. The reflector 34 is connected to the rotary plate 26 so that rotation of the rotary plate 26 causes the reflector a 34 to rotate about the azimuth axis 28. The reflector 34 can be rotated 360° about the azimuth axis 28 so that the reflector 34 can point in any direction along the horizon.

The rotary joint 30 is attached to the rotary plate 26 so that the axis of rotation of the rotary joint 32 is aligned with the azimuth axis 28. The rotation of the rotary plate 26 causes the rotary joint 32 to rotate about the azimuth axis 28. The reflector 34 is positioned on the rotary plate 26 adjacent to the rotary joint 32 so that the azimuth axis 28 does not intersect the reflector 34. The positioning of the reflector 34 adjacent the rotary joint 30 allows the reflector 34 to be positioned closer to the rotary plate 26 so that the microwave reflector antenna 20 has a lower overall height then when the reflector 34 is positioned above the rotary joint 30. Also, with the rotary joint 32 positioned closer to the reflector 34, the radius of rotation of the reflector 34 is less and therefore the radome 80 can be smaller in size.

Preferably, the reflector 34 is positioned on the rotary plate 26 so that the rotary joint 30 is adjacent the convex surface 72 of the reflector 34. The rotary joint 30 allows electric signals to travel between the microwave reflector antenna 20 and the aircraft 24 on which the microwave reflector antenna 20 is mounted. The reduced height of the microwave reflector antenna 20 allows for a smaller radome 80 to be attached to the aircraft 24 to cover the microwave reflector antenna 20. The reduced size of the radome 80 reduces the drag on the aircraft 24 caused by the radome 80 and reduces the cost of the radome 80.

Preferably, the elevation of the reflector 34 is also adjustable. The reflector 34 has a pair of tracks 82 that extend along the convex surface 72 of the reflector 34. A pair of guides 84 are attached to the rotary plate 26. The guides 84 are complementary to the tracks 82. The tracks 82 on the convex surface 72 of the reflector 34 are positioned within the guides 84 so that the tracks 82 can travel along the guides 84. The travelling of the tracks 82 along the guides 84 causes the reflector 34 to rotate about an elevational axis of rotation 86. The tracks 82 and the guides 84 are curved so that when the tracks 82 travel along the guides 84 the reflector 34 rotates about the elevational axis of rotation 86. The curvature of the tracks 82 and the guides 84 can be varied to accommodate a variety of reflectors 34. A plurality of gear teeth 88 are attached to the convex surface 72 of the reflector 34. The plurality of gear teeth 88 could be part of a gear rack. An elevation motor 90 is attached to the rotary plate 26. The elevation motor 90 has a pinion gear (not shown) that is engaged with the plurality of gear teeth 88 on the convex surface 72 of the reflector 34. The rotation of the elevation motor pinion gear causes the tracks 82 on the convex surface 74 of the reflector 34 to travel through the guides 84 and rotate about the elevational axis of rotation 86. Preferably, the elevation motor 90 is a stepper motor so that the rotation of the reflector 34 about the elevational axis of rotation 84 can be accurately controlled. Preferably, as shown in FIG. 1, the plurality of gear teeth 88 on the convex surface 72 of the reflector 34 are integrated into one of the tracks 82. When the plurality of gear teeth 88 are integrated into one of the tracks 82, one of the guides 84 is part of the elevation motor 90 with the elevation motor pinion gear being positioned in the guide 84 so that the pinion gear engages with the plurality of gear teeth 88 on the track 82 of the reflector 34. Preferably, the reflector 34 is positioned on the rotary plate 26 so that rotation of the reflector 34 about the elevational axis of rotation 86 does not cause the reflector 34 to intersect the azimuth axis 28.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A microwave reflector antenna for use on an aircraft, the microwave reflector antenna comprising:

a stationary plate attached to an aircraft, the stationary plate not moving relative to the aircraft;

a rotary plate capable of rotating relative to the stationary plate about an azimuth axis;

a rotary joint attached to the rotary plate and having an axis of rotation that is aligned with the azimuth axis so that rotation of the rotary plate causes the rotary joint to rotate about the azimuth axis;

a reflector attached to the rotary plate and rotating about the azimuth axis with the rotation of the rotary plate, the reflector being positioned adjacent the rotary joint so that the axis of rotation of the rotary joint does not intersect the reflector; and an azimuth motor, the azimuth motor selectively causing the rotary plate to rotate about the azimuth axis.

2. The microwave reflector antenna of claim 1, wherein:

the reflector has an adjustable elevation and is positioned adjacent the rotary joint so that adjustment of the elevation of the reflector does not cause the reflector to intersect the axis of rotation of the rotary joint.

3. The microwave reflector antenna of claim 1, wherein:

the reflector has opposite concave and convex surfaces and the rotary joint is adjacent the convex surface of the reflector.

4. The microwave reflector antenna of claim 1, further comprising:

a radome attached to the aircraft and covering the microwave reflector antenna.

5. The microwave reflector antenna of claim 1, wherein:

individual loose ball bearings are positioned between the stationary plate and the rotary plate so that the rotary plate can rotate relative to the stationary plate about the azimuth axis.

6. The microwave reflector antenna of claim 1, wherein:

the stationary plate has gear teeth that are integral to the stationary plate; and the azimuth motor has a pinion gear that is complementary to and engaged with the gear teeth on the stationary plate so that the azimuth motor can cause the rotary plate to rotate about the azimuth axis.

7. The microwave reflector antenna of claim 2, wherein:

the reflector has an adjustable elevation that allows the reflector to rotate about the elevation axis through at least about 45 degrees.

8. A microwave reflector antenna for use on an aircraft, the microwave reflector antenna comprising:

a stationary plate attached to an aircraft and not moving relative to the aircraft;

a rotary plate capable of rotating relative to the stationary plate about an azimuth axis;

individual loose ball bearings positioned between the stationary plate and the rotary plate so that the rotary plate can rotate relative to the stationary plate about the azimuth axis;

a rotary joint attached to the rotary plate and having an axis of rotation that is aligned with the azimuth axis so that rotation of the rotary plate causes the rotary joint to rotate about the azimuth axis;

a reflector attached to the rotary plate and rotating about the azimuth axis with the rotation of the rotary plate; and an azimuth motor, the azimuth motor selectively causing the rotary plate to rotate about the azimuth axis.

9. The microwave reflector antenna of claim 8, wherein:

the stationary plate has axially opposite top and bottom surfaces and a circular opening extending therebetween with an axial centerline of the circular opening being aligned with the azimuth axis; and the rotary plate has axially opposite top and bottom surfaces and a generally circular peripheral side wall extending axially therebetween, the circular peripheral side wall being complementary to and positioned in the circular opening in the stationary plate so that the rotary plate can be rotated within the stationary plate circular opening.

10. The microwave reflector antenna of claim 9, wherein:

the stationary plate has an axial side wall that defines the circular opening, the axial side wall having an annular recess that extends radially outward from the axial side wall into the stationary plate;

the rotary plate peripheral side wall has an annular recess that extends radially inward from the peripheral side wall toward the azimuth axis;

the stationary plate annular recess and the rotary plate annular recess are aligned and communicate when the rotary plate is positioned in the circular opening in the stationary plate; and the individual loose ball bearings are positioned in the annular recesses between the stationary plate and the rotary plate.

11. The microwave reflector antenna of claim 10, wherein:

the top surface of the stationary plate at the axial side wall is co-planer with the top surface of the rotary plate at the peripheral side wall when the rotary plate is positioned in the circular opening in the stationary plate.

12. The microwave reflector antenna of claim 10, wherein:

the top surface of the stationary plate has an opening along the axial side wall that extends axially into the stationary plate annular recess;

the top surface of the rotary plate has an opening along the peripheral edge that extends axially into the rotary plate annular recess;

the opening in the rotary plate and the opening in the stationary plate form an access opening that extends into the aligned annular recesses when the opening in the rotary plate and the opening in the stationary plate are aligned; and the individual loose ball bearings are positioned in the annular recesses by inserting the individual loose ball bearings through the access opening.

13. The microwave reflector antenna of claim 12, wherein:

the reflector is attached to the rotary plate so that the reflector is adjacent the rotary joint and the axis of rotation of the rotary joint does not intersect the reflector.

14. The microwave reflector antenna of claim 13, wherein:

the reflector has an adjustable elevation and is positioned adjacent the rotary joint so that elevational adjustment of the reflector does not cause the reflector to intersect the axis of rotation of the rotary joint.

15. A microwave reflector antenna for use on an aircraft, the microwave reflector antenna comprising:

a stationary plate attached to an aircraft and having gear teeth that are integral to the stationary plate, the stationary plate not moving relative to the aircraft;

a rotary plate capable of rotating relative to the stationary plate about an azimuth axis;

a rotary joint attached to the rotary plate and having an axis of rotation that is aligned with the azimuth axis so that rotation of the rotary plate causes the rotary joint to rotate about the azimuth axis;

a reflector attached to the rotary plate and rotating about the azimuth axis with the rotation of the rotary plate; and an azimuth motor attached to the rotary plate, the azimuth motor having a pinion gear with teeth that are complementary to and engaged with the gear teeth on the stationary plate, the azimuth motor selectively causing the rotary plate to rotate about the azimuth axis by rotating the pinion gear.

16. The microwave reflector antenna of claim 15, wherein:

the stationary plate has axially opposite top and bottom surfaces and a peripheral side wall therebetween and the stationary plate gear teeth are on the peripheral side wall.

17. The microwave reflector antenna of claim 16, wherein:

the azimuth motor is cantilevered over the top surface of the stationary plate so that the pinion gear can engage with the stationary plate gear teeth on the peripheral side wall.

18. The microwave reflector antenna of claim 17, wherein:

the reflector is positioned adjacent the rotary joint so that the axis of rotation of the rotary joint does not intersect the reflector.

19. The microwave reflector antenna of claim 18, wherein:

the reflector has an adjustable elevation and is positioned adjacent the rotary joint so that adjustment of the elevation of the reflector does not cause the reflector to intersect the axis of rotation of the rotary joint.

20. The microwave reflector antenna of claim 19, further comprising:

individual loose ball bearings are positioned between the stationary plate and the rotary plate so that the rotary plate can rotate relative to the stationary plate about the azimuth axis.

* * * * *